US006260500B1

(12) United States Patent
Coakley

(10) Patent No.: US 6,260,500 B1
(45) Date of Patent: Jul. 17, 2001

(54) EMERGENCY SHIP TOWING SYSTEM

(75) Inventor: David B. Coakley, Hyattsville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/599,580

(22) Filed: Jun. 22, 2000

(51) Int. Cl.[7] ..... B63B 21/56
(52) U.S. Cl. ..... 114/242; 440/33
(58) Field of Search ..... 114/242, 253, 114/221 R, 51; 440/33, 34, 40

(56) References Cited

U.S. PATENT DOCUMENTS 417,755 * 12/1889 Thayer ..... 440/33
3,522,788 * 8/1970 Montague, Jr. ..... 440/40
3,765,355 * 10/1973 Trowbridge ..... 114/51
4,843,996 7/1989 Darche .
5,261,344 11/1993 Pickett .
5,797,343 8/1998 Piene .

* cited by examiner

*Primary Examiner*—Stephen Avila
(74) *Attorney, Agent, or Firm*—Jacob Shuster

(57) ABSTRACT

A thrust unit having an engine as an external source of motive power for a marine vessel in distress, is delivered by helicopter air drop to a remote seawater location together with other components of the associated towing system, delivered onto the deck of such marine vessel for operational assembly and connection to the thrust unit in order to initiate emergency towing of the marine vessel while immersed in the seawater adjacent thereto under control of personnel on the marine vessel.

5 Claims, 5 Drawing Sheets

EMERGENCY SHIP TOWING SYSTEM

The present invention relates generally to seawater towing of marine surface vessels that are in distress.

BACKGROUND OF THE INVENTION

Marine surface vessels in distress during seawater travel sometimes become immobile at some seawater location so as to require an external source of motive power for movement therefrom. The provision of such external motive power source for ship towing purposes, heretofore involved the use of tugboats through which transport of towing apparatus to some seawater location was performed in order to reliably carry out a towing mission on an emergency basis. However, tugboat transport involved substantial transit time following an emergency call from a marine vessel in distress. Accordingly, it is an important object of the present invention to reliably and more quickly perform a towing mission for a ship in distress, involving use of a motive power source externally of the ship at some remote seawater location in response to a distress call from such remote location.

SUMMARY OF THE INVENTION

In accordance with the present invention, components of an emergency ship towing system are selected to perform the towing mission and of a limited weight so as to accommodate safe and rapid transport by helicopter to a remote seawater location at which the towing system components are delivered and operationally assembled by personnel for reliable performance of the towing mission without delay. One of such towing system components, providing the external motive power source, is in the form of a preassmebled thrust unit having a gas turbine type of engine therein, according to one embodiment of the invention, to which a mixture of pressurized air and fuel is supplied through an elongated flexible hose for selective operation of the turbine engine under remote travel speed control. Such thrust unit also includes a rudder and stabilizer assembly through which travel direction and underwater depth control is exercised through elongated signal wiring attached with the flexible hose to an elongated towing cable extending therefrom. The foregoing described type of thrust unit when transported to the required seawater location by the helicopter is dropped through the air for immersion into the seawater adjacent to the ship in distress. The other components of the towing system simultaneously transported by the helicopter to the seawater location, are air dropped onto the deck of the ship in distress for prompt operational assembly thereon by shipboard personnel and attachment to the towing cable, flexible hose and signal wiring extending from the thrust unit immersed in the seawater. On-off control, and selective control over travel speed, direction and underwater depth of the thrust unit during performance of its towing travel operation is thereby effected under control of personnel on the ship through a control box component.

BRIEF DESCRIPTION OF DRAWING

A more complete appreciation of the invention and many of its attendant advantages will be readily appreciated as the same becomes better understood by reference to the following detailed description when considered in connection with the accompanying drawing herein.

DETAILED DESCRIPTION OF THE EMBODIMENT

Figure 1:
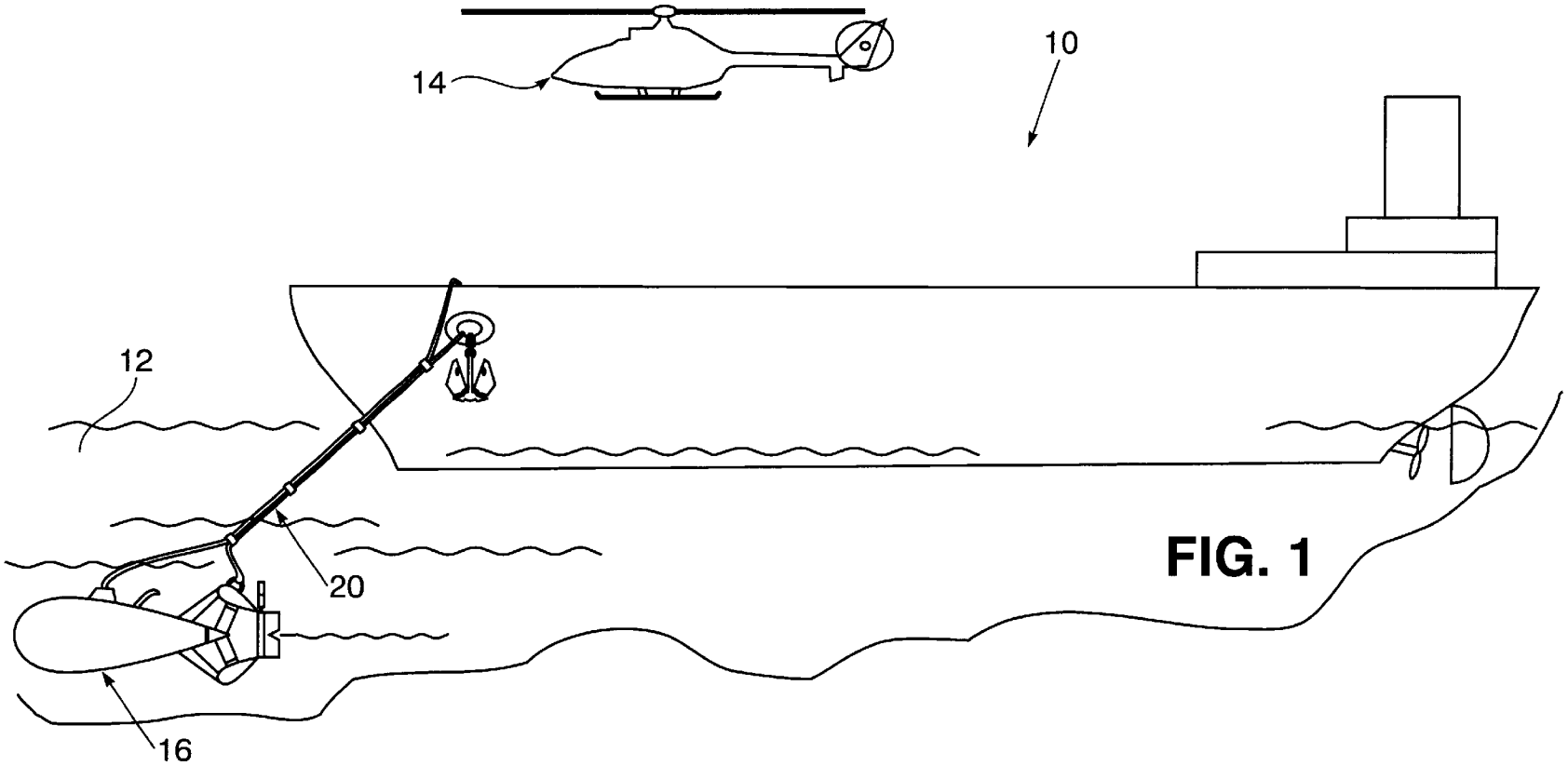
FIG. 1 is a simplified side elevation view of a ship undergoing tow by means of a towing system delivered thereto by a helicopter shown hovering above the ship.
Figure 2:
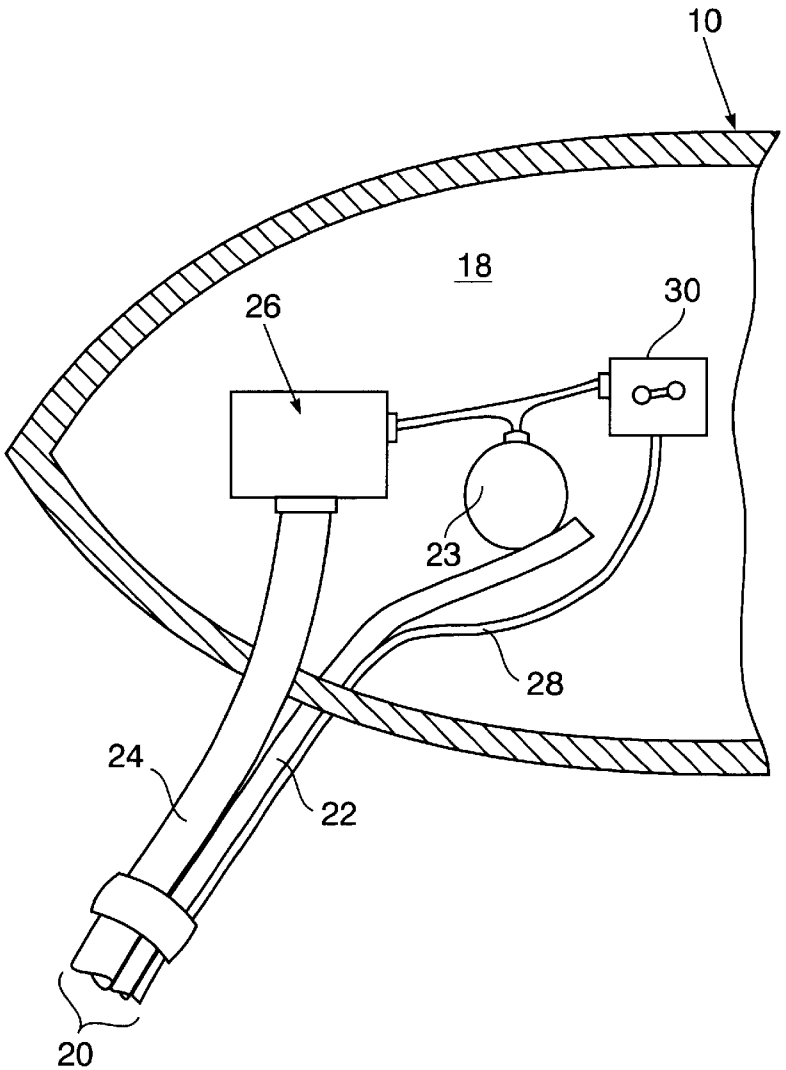
FIG. 2 is a partial top plan view of a forward portion of the ship shown in FIG. 1, illustrating an assembled arrangement of operational components associated with the towing system.

Referring now to the drawing in detail, FIG. 1 illustrates a marine vessel or ship 10 in under tow at some location in a body of seawater 12. Hovering above such ship 10 is a helicopter 14 through which components of an emergency towing system are transported upon call to the distressed ship location, and dropped through the air. One of such components, in the form of a towing thrust unit 16, is delivered by such air drop into the seawater 12 in adjacent relation to the forward portion of the ship 10 as illustrated, while the other emergency towing system components are dropped by the helicopter 14 onto the deck 18 of the ship 10 for assembly thereon by personnel into an arrangement such as that as shown in FIG. 2. All of the towing system components together weigh approximately 4000 lb so as to be transportable by the helicopter 14.

The emergency towing system components transported by the helicopter 14, in addition to the thrust unit 16, include a flexible towing component 20 connected to and extending from the thrust unit 16 onto the forward end portion of the ship deck 18. As shown in FIG. 2, the towing component 20 has associated therewith a flexible cable 22 hooked at one end by personnel to an anchor windlass 23 for example, and an air hose 24 connected to a compressor and fuel assembly 26. The flexible towing component 20 also includes control signal wiring 28 extending from the seawater immersed thrust unit 16 to a control box 30 on the ship deck 18 connected to the compressor and fuel assembly 26 for selective on-off control of the thrust unit 16 with respect to ship travel direction and underwater depth by shipboard personnel.

Figure 3:
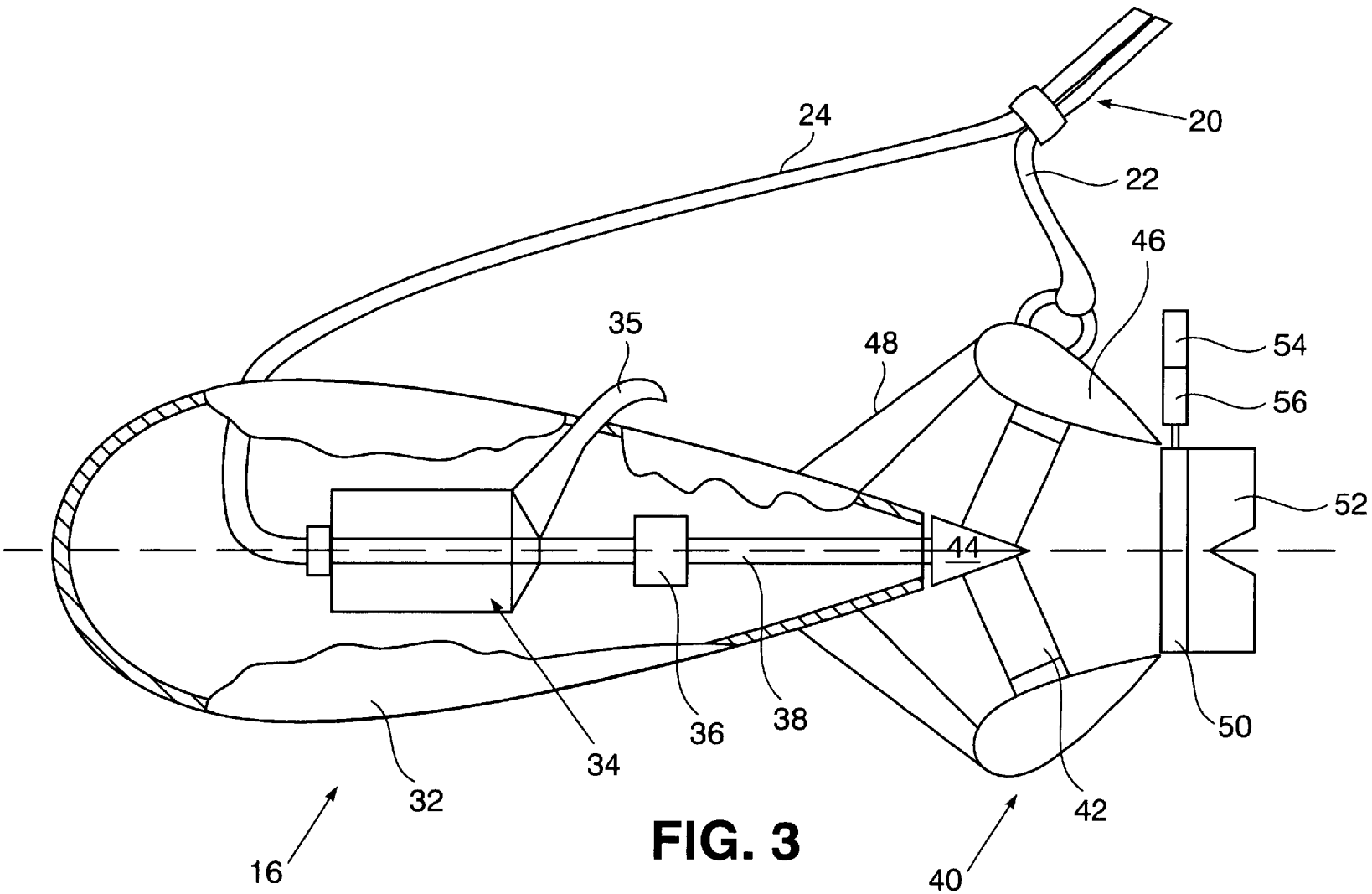
FIG. 3 is a side view in partial section illustrating the preassembled thrust unit component of the towing system.

As shown in FIG. 3, the thrust unit 16 has an outer hydrodynamically shaped housing 32 enclosing an engine 34 such as a gas turbine connected at its inlet end to the air hose 24 through which air mixed with fuel is fed to the turbine engine 34 for operation thereof under selective control. Water outflow from the turbine engine 34 through the housing 32 is conducted by an exhaust control stop lock 35. A speed reducer gearbox 36 mechanically connected to the outlet end of the turbine engine 34 transfers power of approximately 1000 hp at a high torque and low rotational speed to an output shaft 38 connected to a propulsor generally referred to by reference numeral 40. In the illustrated embodiment, the engine driven propulsor 40 includes propeller blades 42 extending radially and rearwardly from a conical shaped rotational hub 44, surrounded by a stator shroud 46 fixed by struts 48 to the thrust unit housing 32 so as to introduce swirl into the propeller plane. A conventional assembly of rudder 50 and stabilizer 52 are mounted by the shroud 46 in rearward relation to the propulsor 40, for setting depth and travel direction through servomotors 54 and 56.

Figure 4:
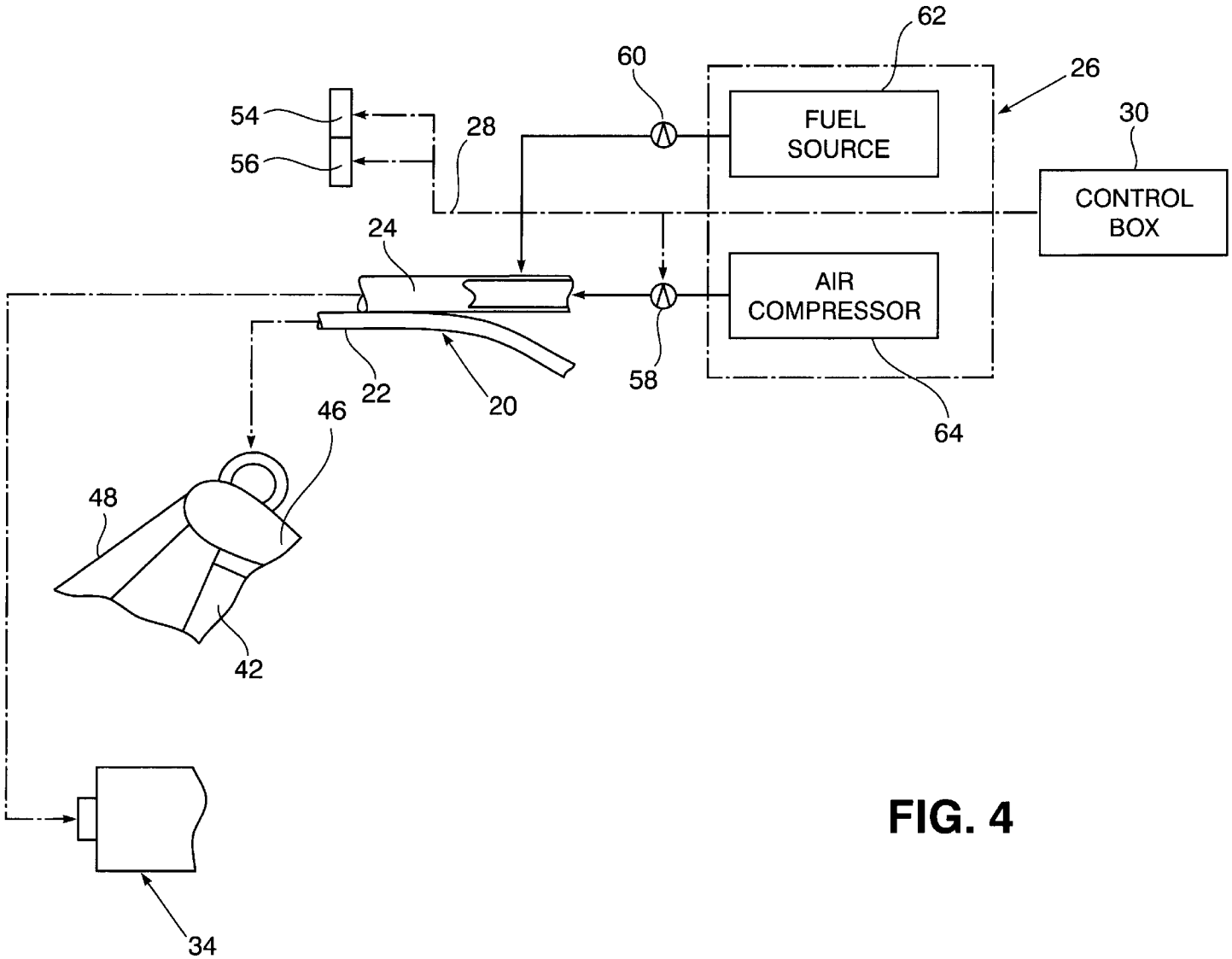
FIG. 4 is a block diagram illustrating selective controls associated with the components of the towing system shown in FIGS. 2 and 3.

As diagrammed in FIG. 4, the servomotors 54 and 56 are respectively under pneumatic control of direction and depth signals supplied thereto by the wiring 28 from the control box 30. Such depth signals are derived form readings of a depth gage combined with depth command from the control box 30 pursuant to a control scheme such as proportional, proportion a 124 derivative or proportional-derivative-integral to maintain depth by control of stabilizers 52. The gas turbine 34, on the other hand, is controlled by the control box 30 through a valve 58 supplying fuel from a fuel source 62 in the assembly 26 to the hose 24 for mixing with pressurized air therein supplied thereto through a valve 60 from an air compressor 64.

Figure 5:
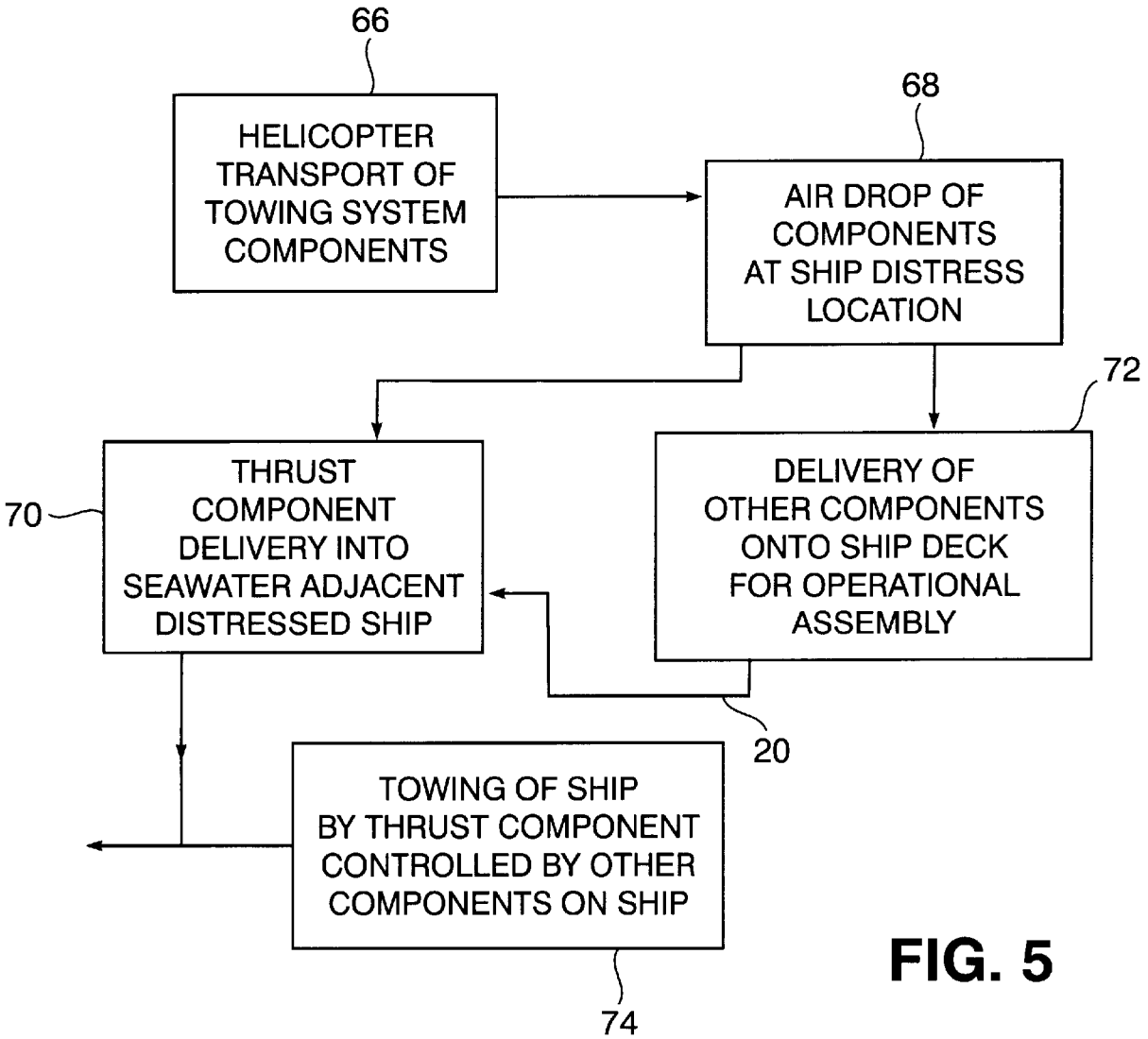
FIG. 5 is a block diagram schematically summarizing the towing system procedure associated with the embodiment of the invention depicted in FIGS. 1–4.

FIG. 5 diagrammatically summarizes the operational procedure associated with the present invention as hereinbefore described. The towing system components are transported for helicopter air drop, as denoted by reference numeral 66, to the ship distress location 68. Delivery 70 of one of the towing system components, in the form of the thrust unit 16, is thereby effected into the seawater 12 adjacent to the distressed ship 10 while the other towing system components connected to the thrust unit 16 by the flexible towing assembly 20, undergo delivery and operational assembly 72 on the ship deck 18. Towing 74 of the distressed ship 10 is thereby effected under selective operator control with respect to travel speed, direction and underwater depth through the control box 30 as hereinbefore described.

Obviously, other modifications and variations of the present invention may be possible in light of the foregoing teachings. For example, the gas turbine engine 34 could be replaced by a Diesel engine while the propulsor 40 may be replaced by one employing contra-rotating blades. The elongated cable 20 may be replaced by one without the air hose 24, connected to a thrust unit in the form of a scharkel. The thrust unit 16 may accordingly be replaced by one having an electric motor with an electromagnetic cable connected to a portable generator on the ship, or by one having limited fuel and air supplies therein. As yet another alternative, the thrust unit which crawls down the side of the ship may be utilized, involving use of electromagnetic tracks and stops on the bottom of the ship hull and magnets to maintain the thrust unit in place while approximately 1000 hp is delivered as motive power for the ship. It is therefore to be understood that within the scope of the appended claims the invention may be practiced otherwise than as specifically described.

What is claimed is:

1. In combination with a system for towing a marine vessel in distress from a seawater location under selected travel speed, direction and underwater depth by means of a thrust unit in the seawater connected by flexible means to the marine vessel and a plurality of other components of the towing system through which control of said selected travel speed and underwater depth are effected from the marine vessel, a method including the steps of: transporting said thrust unit and the other components by helicopter to the seawater location; respectively delivering the thrust unit by helicopter air drop at said location into the seawater and the other components onto the marine vessel; and operationally assembling said other components on the marine vessel for connection by the flexible means to the delivered thrust unit to initiate towing.

2. The combination as defined in claim 1, wherein said thrust unit includes an engine through which said control over the selective travel speed is effected, and a rudder/stabilizer assembly through which said selective control over the travel direction and underwater depth is effected.

3. The combination as defined in claim 2, wherein said other components delivered by said air drop onto the marine vessel include: a fuel source; an air compressor; valve means respectively supplying fuel from the source and air from the compressor for intermixing and feeding by the flexible means to the engine; and control box means connected to the valve means and the rudder/stabilizer assembly for effecting said selective control over the travel speed, direction and underwater depth.

4. The combination as defined in claim 1, wherein said other components delivered by said air drop onto the marine vessel include: a fuel source; an air compressor; valve means respectively supplying fuel from the source and air from the compressor for intermixing and feeding by the flexible means to the thrust unit; and control box means connected to the valve means and the thrust unit for effecting said selective control over the travel speed, direction and underwater depth.

5. In combination with a system for towing a marine vessel in distress from a seawater location by means of a thrust unit in the seawater connected to the marine vessel and a plurality of other components of the system through which travel imparted to the marine vessel by the thrust unit is selectively controlled from the marine vessel, a method including the steps of: transporting said thrust unit and the other components by helicopter to said seawater location; delivering the thrust unit and the other components to said seawater location by helicopter air drop; and operationally assembling said other components on the marine vessel after said delivery thereof to initiate towing.

* * * * *